US008337167B2

(12) United States Patent
Lefebvre et al.

(10) Patent No.: US 8,337,167 B2
(45) Date of Patent: Dec. 25, 2012

(54) METHOD FOR CONTROLLING A COMPRESSED AIR UNIT AND A CONTROLLER AND COMPRESSED AIR UNIT FOR APPLYING SUCH A METHOD

(75) Inventors: Tine Maria Antoinette Lefebvre, Jette (BE); Johan Georg Urban Pettersson, Tervuren (BE)

(73) Assignee: Atlas Copco Airpower, Naamloze Vennootschap, Wilrijk (BE)

( * ) Notice: Subject to any disclaimer, the term of this patent is extended or adjusted under 35 U.S.C. 154(b) by 777 days.

(21) Appl. No.: 12/374,303

(22) PCT Filed: Jun. 21, 2007

(86) PCT No.: PCT/BE2007/000064

§ 371 (c)(1),
(2), (4) Date: Jan. 17, 2009

(87) PCT Pub. No.: WO2008/009073

PCT Pub. Date: Jan. 24, 2008

(65) Prior Publication Data

US 2009/0246036 A1 Oct. 1, 2009

(30) Foreign Application Priority Data

Jul. 18, 2006 (BE) ..... 2006/0394

(51) Int. Cl.
*F04B 43/12* (2006.01)

(52) U.S. Cl. ..... 417/53

(58) Field of Classification Search ..... 417/53
See application file for complete search history.

(56) References Cited

U.S. PATENT DOCUMENTS

| | | | | |
|---|---|---|---|---|
| 4,502,842 | A * | 3/1985 | Currier et al. | 417/8 |
| 7,136,781 | B2 | 11/2006 | Saito et al. | |
| 2004/0151593 | A1 | 8/2004 | Saarinen et al. | |

FOREIGN PATENT DOCUMENTS

| | | | |
|---|---|---|---|
| JP | 61-201900 | A | 9/1986 |
| JP | 2003-091313 | A | 3/2003 |
| WO | WO 96/16271 | | 5/1996 |
| WO | WO 98/32971 | | 7/1998 |

OTHER PUBLICATIONS

Office Action issued in related Japanese application No. 2009-519752, Oct. 11, 2011.

* cited by examiner

*Primary Examiner* — Anh T. Mai
*Assistant Examiner* — Hana Featherly
(74) *Attorney, Agent, or Firm* — Bacon & Thomas, PLLC

(57) ABSTRACT

Method for controlling a compressed air unit having one or several compressed air networks, as well as a number of communicating controllers for controlling components that are part of the compressed air networks. The control of the above-mentioned components is such that none of the communicating controllers determines the operational condition of any component that is controlled by other controllers.

13 Claims, 2 Drawing Sheets

METHOD FOR CONTROLLING A COMPRESSED AIR UNIT AND A CONTROLLER AND COMPRESSED AIR UNIT FOR APPLYING SUCH A METHOD

FIELD OF THE INVENTION

The present invention concerns a method for controlling a compressed air unit.

In particular, the present invention concerns a method for controlling a compressed air unit comprising one or several compressed air networks, as well as a number of communicating controllers for controlling components that are part of an aforesaid compressed air network.

By compressed air unit is meant any installation making use of a compressed gas which is not necessarily restricted to compressed air.

BACKGROUND

It is already known to separately control a number of compressors that are part of a compressed air unit by means of a separate controller, whereby the different controllers are not connected to each other, and whereby each of these controllers is set at a different pressure value so as to switch the compressors sequentially on or off, depending on the consumption of compressed air.

It is also known to apply what is called a centralised control, whereby several compressors are controlled by means of a single controller, to which end said controller determines the operational condition of all these compressors at any time.

Finally, also another method for the centralised control of a compressed air unit is known whereby several mutually connected controllers are used to control a number of compressors which are connected to these respective controllers and whereby at least one of these controllers determines the operational condition of each of said compressors at any time.

As a result, one of the controllers can function as a "master" at any time, giving orders to the other "slave" controllers to control the respective compressors connected to the latter.

Another possible application of such a configuration consists in that each of the controllers determines the operational condition of all the compressors and controls is only those compressors connected to it, taking into account the condition of the other compressors.

A disadvantage of the known methods is that they only make it possible to control simple compressed air networks with relatively few components.

Another disadvantage is that such a method quickly leads to the use of complicated controllers, which are expensive and which make the lay-out and control logic of such a compressed air unit relatively extensive and complex, especially when many parameters have to be taken into account.

SUMMARY

The present invention aims to remedy one or several of the above-mentioned and other disadvantages.

To this end, the present invention concerns a method for controlling a compressed air unit comprising one or several compressed air networks, as well as a number of communicating controllers for controlling components that are part of an aforesaid compressed air network, whereby the above-mentioned components are controlled such that none of the controllers determines the operational condition of any component that is controlled by other controllers.

A major advantage of such a method according to the invention is that it can be applied in complex and extensive compressed air units, whereas only a number of simple, mutually connected controllers need to be used, as a result of which the control logic and the complexity of this compressed air unit are restricted.

The present invention also concerns a controller for applying a method according to the invention, which controller is part of a series of controllers in a compressed air unit comprising one or several compressed air networks, whereby the above-mentioned series of communicating controllers is provided to control components that are part of an aforesaid compressed air network, and whereby the above-mentioned controller is made such that it does not determine the operational condition of any component that is controlled by other controllers in the compressed air unit.

The present invention also concerns a compressed air unit for applying a method according to the invention, which compressed air unit comprises one or several compressed air networks, as well as a number of communicating controllers for controlling components that are part of an aforesaid compressed air network, whereby the above-mentioned controllers are made such that none of them determines the operational condition of any component that is controlled by other controllers.

BRIEF DESCRIPTION OF THE DRAWINGS

In order to better explain the characteristics of the present invention, a preferred method according to the invention is described, as well as a controller and a compressed air unit for applying such a method, with reference to the accompanying drawings, in which.

DETAILED DESCRIPTION OF EXEMPLARY EMBODIMENTS OF THE DISCLOSURE

Figure 1:
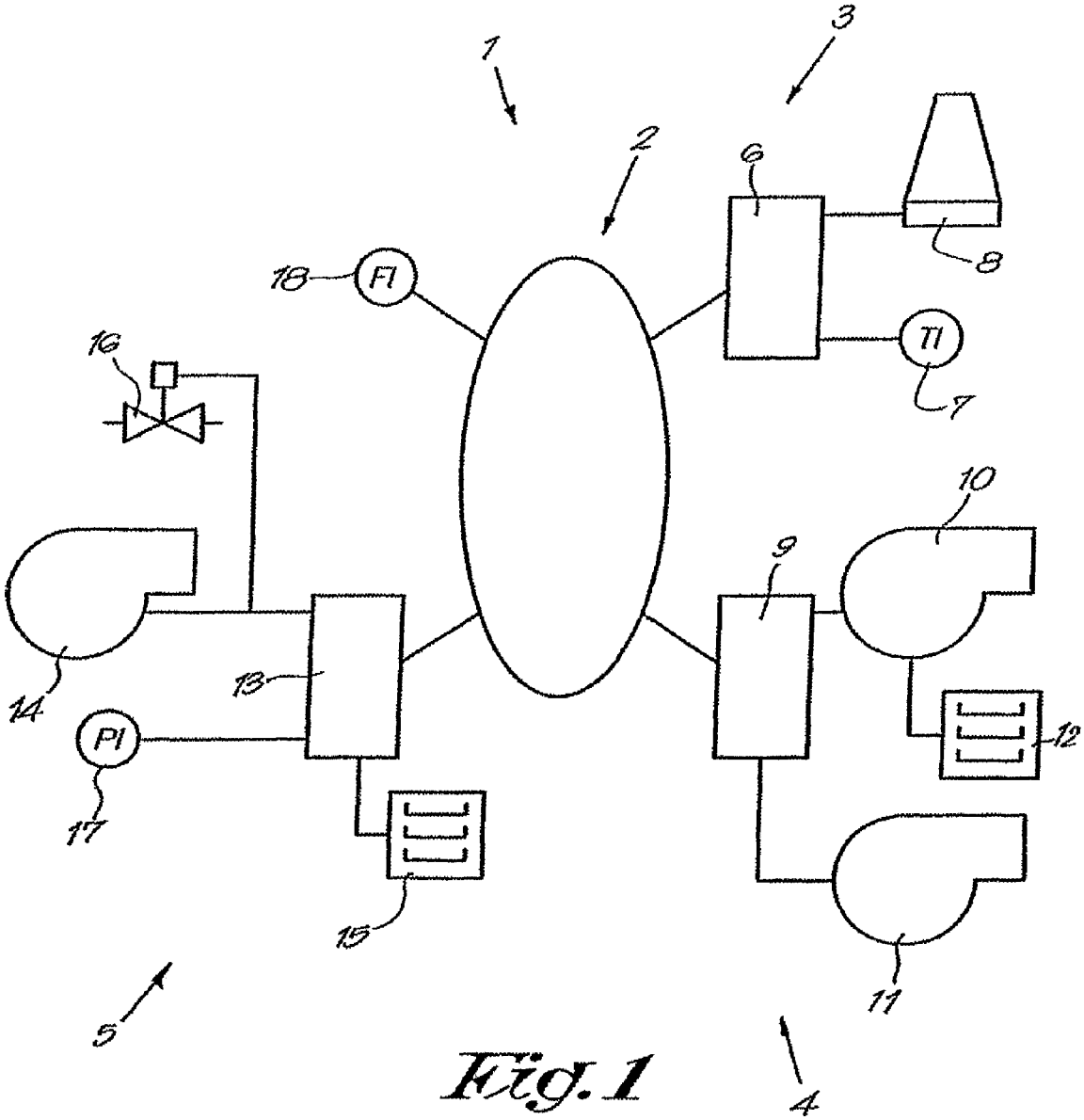
FIG. 1 represents a compressed air unit that is controlled with a method according to the invention.

FIG. 1 represents a compressed air unit that can be controlled with a method according to the invention, to which end, in this case, the compressed air unit 1 comprises a communication network 2 to which are connected three branches 3, 4 and 5.

The first branch 3 in this case comprises a first controller 6 of a series of controllers, whereby a temperature sensor 7 and a cooling tower 8 are connected to this controller 6.

The second branch 4 is provided with a second controller 9 of a series of controllers, which controller 9 directly controls two compressors 10 and 11 and indirectly controls a dryer 12 which is connected to the above-mentioned compressor 10.

The third branch 5 comprises a third controller 13 that is part of the above-mentioned series of controllers, which third controller 13 controls a compressor 14, a dryer 15 and a controllable valve 16 and to which also a pressure sensor 17 is connected in this case.

Finally, also a flow rate sensor 18 is connected to the above-mentioned network 2.

In the given example, the different components of the compressed air unit 1 are represented as loose components that are not mutually connected, but it is clear that these components can be configured in any interconnection whatsoever and thus can be mutually connected in any way whatsoever, and that they can thus be part of a single compressed air network.

However, it is not excluded according to the invention for these components to belong to different compressed air networks, either or not in groups.

In this case, each of the above-mentioned compressors 10, 11 and 14 is made controllable, for example as it is driven in the known manner by a motor with an adjustable speed, not represented in the figure, which is connected to a respective controller 9 or 13.

Also the above-mentioned valve 16 is in this case controllable, for example as it is controlled by means of a servomotor, not represented in the figures, which is also connected to an above-mentioned controller 13.

The dryers 12 and 15 can be controlled, by way of a non-restrictive example, by controlling a frequency-controlled motor, not represented in the figures, that drives the drum of an adsorption dryer or by controlling a frequency-controlled motor that drives the compressor of a cooling dryer.

The cooling tower 8 can be controlled for example by adjusting the rotational speed of the driving motor of a non-represented fan or the like, which sucks in cooling air through the cooling tower 8.

The method for controlling the compressed air unit 1 is characterised in that the above-mentioned communicating controllers 6, 9 and 13 provide for what is called a distributed control of the compressed air unit 1, meaning that none of the communicating controllers 6, 9 or 13 determines the operational condition of any component that is controlled by other controllers.

In this case, each controller 6, 9 and 13 only determines the operational condition of the components that are directly and indirectly connected to it. In practice, this means that in the given example, the controller 6 determines the operational condition of the above-mentioned cooling tower 8, whereas the controller 9 determines the operational condition of the compressors 10 and 11 and of the dryer 12, and that finally, the controller 13 determines the operational condition of the compressor 14, the dryer 15 and the valve 16.

In order to provide for a stable and efficient control, the different controllers 6, 9 and 13 mutually communicate via the above-mentioned network 2.

Since, according to the invention, none of the controllers 6, 9 or 13 knows the operational condition of all the components of the compressed air unit 1, the above-mentioned communication between the controllers 6, 9 and 13 is arranged such these controllers do not communicate all data of the components connected thereto to the other controllers, but such that for example only a limited part of these data or a characteristic derivative thereof is transmitted to said other controllers, which characteristic value forms an indicator of a "virtual" component of the compressed air unit 1.

Each of the controllers 6, 9 and 13 subsequently compares the data coming from the other controllers and finally determines the points of operation of the components of the compressed air unit 1 connected to the controller concerned, either or not partly on the basis of the measurement data of one or several of the sensors 7, 17 and/or 18.

In a practical example whereby the compressors 10, 11 and 14 are part of one and the same compressed air network, the controller 13 can for example calculate the required flow rate of compressed gas that should be supplied to the compressed air network on the basis of a pressure measurement from pressure sensor 17.

On the basis of this calculation, the controller 13, which in this case is the "master" controller, can determine the most suitable segmentation of the contribution of the compressor 14 and of the whole of compressors 10 and 11 that are coupled to the controller 9, namely on the basis of the virtual characteristics that are stored in the controller 9, which controller 9 is the "slave" controller.

The "master" controller 13 will hereby control the compressor 14 in an appropriate manner on the one hand and transmit a calculated desired value to the controller 9 via the network 2 on the other hand.

The controller 9 in turn controls the compressors 10 and 11, such that the compressors 14, 10 and 11 together make sure that the calculated desired value of the pressure in the compressed air unit 1 can be reached, namely according to the most appropriate distribution code that is determined for example on the basis of the lowest consumption, the lowest maintenance, the longest life or the like.

According to the invention, the controller 9 never knows the operational condition of the compressor 14 and, vice versa, the controller 13 never knows the operational condition of the compressors 10 or 11, but only a characteristic value for both compressors 10 and 11.

Although the preceding example only mentions a control of compressors, it is clear that analogous methods can be used for the other controllable components of the compressed air unit 1.

Moreover, the controller 13 must not necessarily be "master", while the controller 9 is "slave"; the opposite is possible just as well, or it is even possible that both controllers 9 and 13 are equal and determine the distribution code via intercommunication.

A method according to the invention can be applied sequentially, whereby several of the controllable components of the compressed air unit 1 are put in a pre-determined sequence.

With such a sequential method, each time the demands of a compressed air user cannot be met by the already activated components or in case the good working order of the compressed air unit 1 cannot be further guaranteed, a subsequent component of the sequence will be activated.

Conversely, if the working of all the components is no longer required to be able to meet the demands of the above-mentioned compressed air user, the last component of the above-mentioned sequence will be disconnected.

It is clear that, instead of switching them on and off, the different components can also be controlled in a continuous manner on the basis of the compressed air consumption of the compressed air unit 1.

According to the invention, it is possible that components of a different type, such as compressed air sources, compressed air users, processing devices for compressed air and compressed air valves are implemented in a separate sequence per type of component, but these different types can be also be intermingled in sequences.

According to the invention, the different sequences can be set by an operator and/or they can be defined on the basis of identifiable variables, such as for example time, date, pressure, flow rate, dew point, air quality and/or temperature.

According to a special characteristic of the invention, the different controllable components of the compressed air unit 1 can be controlled such that each of them is active for a certain time span, in order to stagger the wear of said different components and thus extend the life of the compressed air unit 1.

The above-mentioned time settings can be inputted by an operator and/or they can be based on certain variables, such as for example time, date, pressure, flow rate, dew point, air quality and/or temperature.

In a method according to the invention is preferably implemented an algorithm that makes sure that the maintenance of different components of the compressed air unit 1 can be done simultaneously.

The control of the different components of the compressed air unit 1 can be based on different parameters which influence the maintenance requirements, such as among others the number of working hours and the working conditions.

According to a preferred characteristic of the invention, an energy-saving algorithm is applied with the method for controlling a compressed air unit 1, whereby an optimized energy consumption of at least a part of the compressed air unit 1 is obtained by setting the operational point of one or several of its components such that the energy consumption is as low as possible, while a good working of the compressed air unit 1 is nevertheless guaranteed.

As an option, a method according to the invention can be realised such that the components of the compressed air unit 1 are controlled in such a way that the costs of among others energy consumption and maintenance, repairs, replacements and the like of components of the compressed air unit 1 and/or of the compressed air unit 1 as a whole are always restricted to a minimum.

Finally, in order to apply the method according to the invention, also a control algorithm can be used whereby the compressed air unit 1 is controlled such that one or several parameters, with as non-restrictive examples temperature, pressure, dew point, volume, air quality and flow rate are conformed to a certain directional value or whereby one or several of these parameters are kept within a certain range by controlling the suitable components by means of one or several of the above-mentioned controllers 6, 9 and/or 13.

Figure 2:
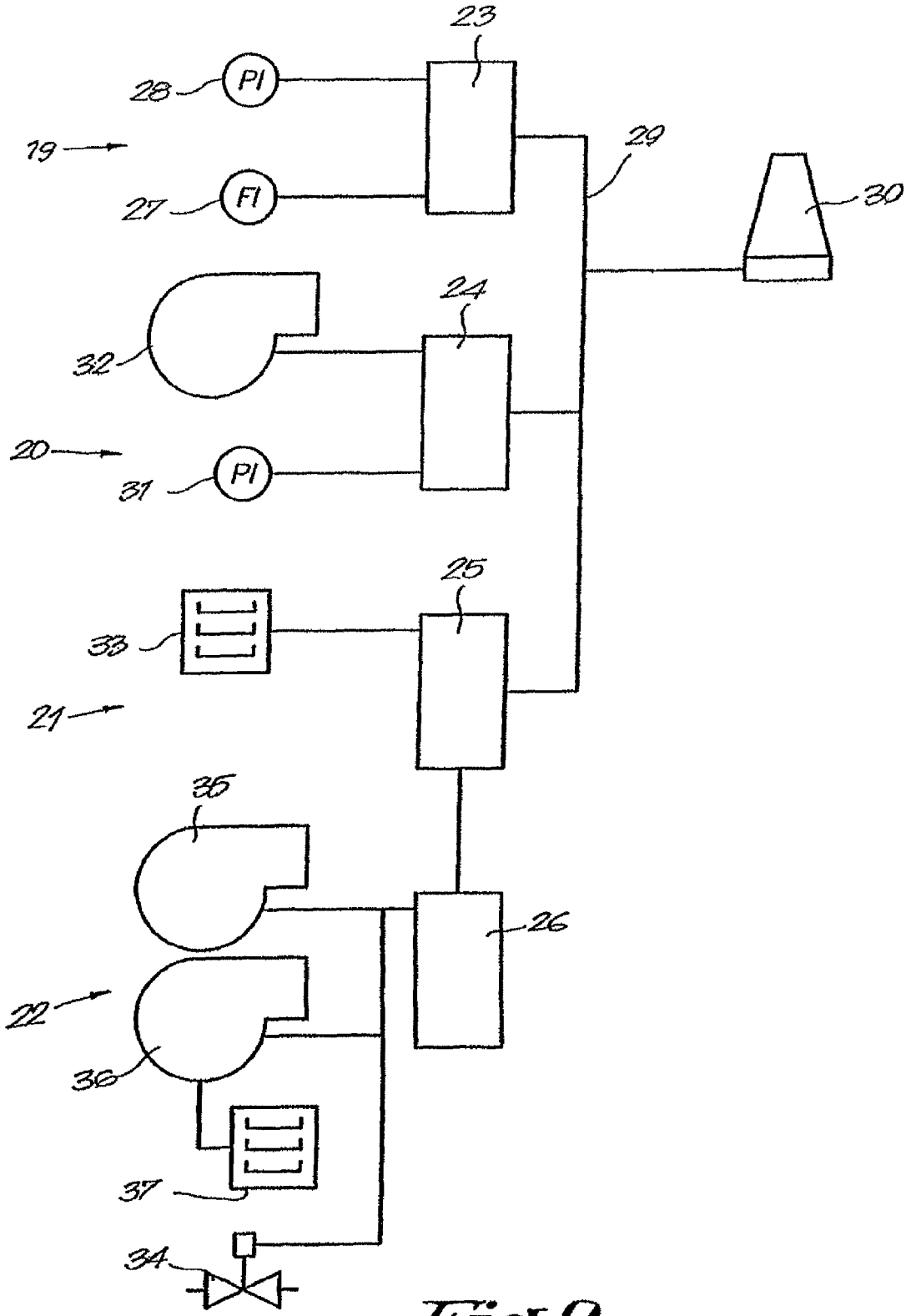
FIG. 2 represents a variant according to FIG. 1.

FIG. 2 represents a variant of a compressed air unit 1 according to the invention which comprises a network provided with four branches 19 to 22 which are in this case each provided with a controller, 23 to 26 respectively.

To the controller 23 is connected a flow rate sensor 27 and a pressure sensor 28.

Further, this controller 23 is directly connected to the controllers 24 and 25 and to a cooling tower 30 via a communication network 29.

The controller 24 is in turn connected to a pressure sensor 31 and to a compressor 32, whereas the controller 25 is connected to a dryer 33 and to the last controller 26.

Finally, to this last controller 26 are connected a controllable valve 34 and two compressors 35 and 36, whereby the compressor 36 is connected to a dryer 37.

It is clear that in this case as well, the controllable components of the compressed air unit 1 can be part of a single compressed air network or they can belong to different compressed air networks.

The method that is applied when controlling the compressed air unit 1 according to this FIG. 2 is analogous to the method described above with reference to the compressed air unit 1 from FIG. 1.

In this case as well, a distributed control of the compressed air unit 1 is applied, whereby none of the communicating controllers 23 to 26 determines the operational condition of any component that is controlled by other controllers.

In this case, the controller 26 determines the operational condition of the valve 34, the dryer 37 and the compressors 35 and 36, directly or indirectly, and calculates a characteristic derivative value on the basis of these data which represents the operational condition of a "virtual" component of the compressed air unit 1 and which is detected by the controller 25, which also determines the operational condition of the dryer 33.

In this way, the controller 25 never knows the precise operational condition of the compressors 35, 36, the dryer 37 or the valve 34, but it only knows a general value that is indicative of their actual condition.

Subsequently, the controllers 23 and/or 24 can in an analogous manner determine the operational condition of the components that are directly connected to them.

On the basis of the data received by every controller 23 to 26, each of these controllers 23 to 26 controls the respective components that are connected to them.

It is clear that the controllers 6, 9, 13 and 23 to 26 of a compressed air unit 1 according to the invention can be connected to any of, but at least to one of the following components or a combination thereof: a compressed air user, a compressed air source, a processing device for compressed air or a compressed air valve.

By the term compressed air user is meant any possible user of compressed air, such as for example pneumatic tools.

By the term compressed air source is meant any source of compressed gas, such as for example screw-type compressors, piston compressors, fans and the like which are not restricted to the supply of compressed air, but which can also be applied for any other type of compressed gas.

By a processing device for compressed air is meant any device that is designed to alter the quality or the physical parameters of the compressed air, such as for example dryers, heat exchangers, filters, moisture and oil separators and the like.

By compressed air valves are meant any possible embodiments of controllable valves, valves, shut-off valves, mixing taps, throttling valves and the like.

In the given examples, each of the above-mentioned components of the compressed air units 1 of FIGS. 1 and 2 are connected to a respective controller 6, 9, 13, 23, 24, 25 or 26 by means of physical pipes.

It is clear that such a connection can also be made wireless and that it does not necessarily have to be realised directly but that it can also be made indirectly, for example via separate communication units.

It is clear that the above-mentioned controllers 6, 9, 13 and 23 to 26 can be made not only as separate units but also as built-in elements which may either or not comprise one or several of the following elements: an arithmetic unit, a memory, a screen, peripherals and/or sensors for data input and/or a communication part for transmitting and receiving signals.

The present invention is by no means limited to the method, controller and compressed air unit described as an example; on the contrary, such a method according to the invention for controlling a compressed air unit and a controller and compressed air unit for applying such a method can be made according to all sorts of variants while still remaining within the scope of the invention.

The invention claimed is:

1. A method for controlling a compressed air unit comprising the steps of:

providing at least one compressed air network, and a plurality of communicating controllers arranged for controlling a plurality of components forming part of the at least one compressed air network; and controlling the components such that each controller of said plurality of controllers determines the operational condition of only a part of all the components that are controlled by other controllers of said plurality of controllers.

2. The method according to claim 1, wherein the components of the compressed air unit includes one of the following elements selected from the group consisting of: a compressed air user, a compressed air source, a processing device for compressed air and a compressed air valve.

3. The method according to claim 1, wherein at least two of the controllable components of the compressed air unit are arranged in a pre-determined sequence and are switched on or off, or are adjusted according to said sequence on the basis of the compressed air consumption of the compressed air unit.

4. The method according to claim 3, wherein different types of the components are arranged in a separate sequence.

5. The method according to claim 3, wherein different types of the components are intermingled in sequences.

6. The method according to claim 3, wherein the different sequences are set by an operator, are defined on the basis of variables, or combinations thereof.

7. The method according to claim 6, wherein the variables are selected from the group consisting of time, date, pressure, flow rate, dew point, air quality, temperature and combinations thereof.

8. The method according to claim 1, wherein the controllable components of the compressed air unit are controlled such that they are each operational for a certain time span so as to stagger the wear of these different components.

9. The method according to claim 1, wherein the components of the compressed air unit are controlled such that the maintenance of these components is carried out simultaneously.

10. The method according to claim 1 further comprising the step of executing an energy-saving algorithm, wherein an optimized energy consumption of at least a part of the compressed air unit is obtained by adjusting the point of operation of one or several of the components.

11. The method according to claim 1, wherein the components of the compressed air unit are controlled such that the costs for energy consumption and maintenance, repairs, and replacements of components of the compressed air unit, or of the compressed air unit as a whole are always restricted to a minimum.

12. The method according to claim 1 further comprising the step of executing a control algorithm wherein the compressed air unit is controlled such that one or several parameters are conformed to a certain directional value or one or several of the parameters are kept within a certain range by controlling the selected components of the compressed air unit by means of a selected controller.

13. A compressed air unit comprising at least one compressed air network, and a number of communicating controllers for controlling components forming part of the compressed air networks, wherein the controllers are arranged such that each controller of said plurality of controllers determines the operational condition of only a part of all the components that are controlled by other controllers of said plurality of controllers.

* * * * *